US008967152B1

(12) United States Patent
Chowdhury

(10) Patent No.: US 8,967,152 B1
(45) Date of Patent: Mar. 3, 2015

(54) CIGARETTE FILTER TIP

(76) Inventor: Khorshed A. Chowdhury, Lauderhill, FL (US)

( * ) Notice: Subject to any disclaimer, the term of this patent is extended or adjusted under 35 U.S.C. 154(b) by 796 days.

(21) Appl. No.: 13/225,763

(22) Filed: Sep. 6, 2011

(51) Int. Cl.
*A24D 3/04* (2006.01)

(52) U.S. Cl.
USPC ..... 131/178

(58) Field of Classification Search
None
See application file for complete search history.

(56) References Cited

U.S. PATENT DOCUMENTS

| | | | | |
|---|---|---|---|---|
| 2,260,206 | A * | 10/1941 | Bellinghieri | 131/328 |
| 4,869,275 | A | 9/1989 | Berger | |
| 4,877,040 | A | 10/1989 | Jansma et al. | |
| 5,497,791 | A | 3/1996 | Bowen et al. | |
| 5,752,527 | A | 5/1998 | Bowen et al. | |

* cited by examiner

*Primary Examiner* — Michael J Felton
(74) *Attorney, Agent, or Firm* — Crossley Patent Law

(57) ABSTRACT

A cigarette filter tip that includes a turbo fan activated by the breath, which turbo fan homogenizes and evenly distributes smoke to pass through a first filter and subsequently a second filter before being inhaled into the body.

4 Claims, 3 Drawing Sheets

CIGARETTE FILTER TIP

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Various types of cigarette filter tips are known in the prior art. However, what is needed is a cigarette filter tip that includes a turbo fan activated by the breath, which turbo fan homogenizes and evenly distributes smoke to pass through a first filter and subsequently a second filter before being inhaled into the body.

FIELD OF THE INVENTION

The present invention relates to a cigarette filter tip, and more particularly, to a cigarette filter tip that includes a turbo fan activated by the breath, which turbo fan homogenizes and evenly distributes smoke to pass through a first filter and subsequently a second filter before being inhaled into the body.

SUMMARY OF THE INVENTION

The general purpose of the cigarette filter tip, described subsequently in greater detail, is to provide a cigarette filter tip which has many novel features that result in a cigarette filter tip which is not anticipated, rendered obvious, suggested, or even implied by prior art, either alone or in combination thereof.

Smoking is harmful to the health. Many filter tips and accessories exist in the prior art attempting to mitigate the harmful effects of smoking by capturing tar and other harmful agents disposed within cigarette smoke. However, what is needed is a cigarette filter tip that includes a turbo fan activated by the breath, which turbo fan homogenizes and evenly distributes smoke to pass through a first filter and subsequently a second filter before being inhaled into the body.

The present device, therefore, includes a hollow right circular cylindrical casing, said casing having a distal end and a proximal end. A guide collar is disposed on the distal end, said guide collar including a frustroconical skirting flared distally outward from the casing; a right circular cylindrical body member disposed within the casing proximal the distal end; and a crenate piece with a plurality of converging teeth disposed facing the proximal end of the casing. This guide collar is configured to releasably receive a cigarette therein, the crenate piece releasably securing a cigarette butt between the converging teeth.

A turbo fan is disposed immediately behind the crenate piece. The turbo fan includes a plurality of blades disposed around a central piece. The turbo fan is rotatable in a transverse plane relative the casing. When smoke is inhaled into the device, the turbo fan spins, and smoke drawn through the plurality of blades is homogenized and evenly distributed into a first filter disposed within the casing immediately behind the turbo fan. A second filter is disposed immediately behind the first filter, the second filter proximal the proximal end of the casing. The fan can be used in a regular filter tip.

A strainer, with a plurality of holes disposed therethrough, is disposed at the proximal end of the casing. Smoke inhaled into the device therefore passes through the turbo fan, where it is homogenized and evenly distributed into the first filter and subsequently the second filter, before exiting the device through the plurality of holes disposed within the strainer. Smoke is then inhaled into the body of a person smoking with the device.

It is envisioned that additives within the first and second filter may flavor and alternately react with harmful agents within the smoke, to mitigate and reduce the harmful effects of smoking. The turbo fan thusly increases the effect of the first filter and the second filter by homogenizing the smoke and evenly distributing the smoke to increase the contact of smoke particles with the active surfaces of each of the first and second filters.

Thus has been broadly outlined the more important features of the present cigarette filter tip so that the detailed description thereof that follows may be better understood and in order that the present contribution to the art may be better appreciated.

Objects of the present cigarette filter tip, along with various novel features that characterize the invention are particularly pointed out in the claims forming a part of this disclosure. For better understanding of the cigarette filter tip, its operating advantages and specific objects attained by its uses, refer to the accompanying drawings and description.

BRIEF DESCRIPTION OF THE DRAWINGS FIGURES

DETAILED DESCRIPTION OF THE DRAWINGS

Figure 1:
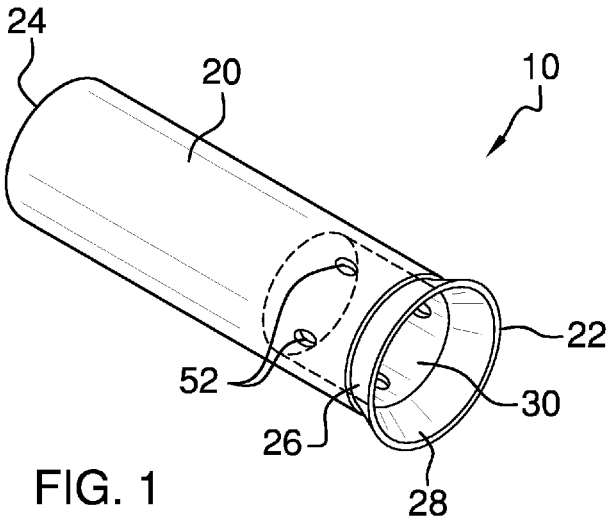
FIG. 1 is a front isometric view.
Figure 2:
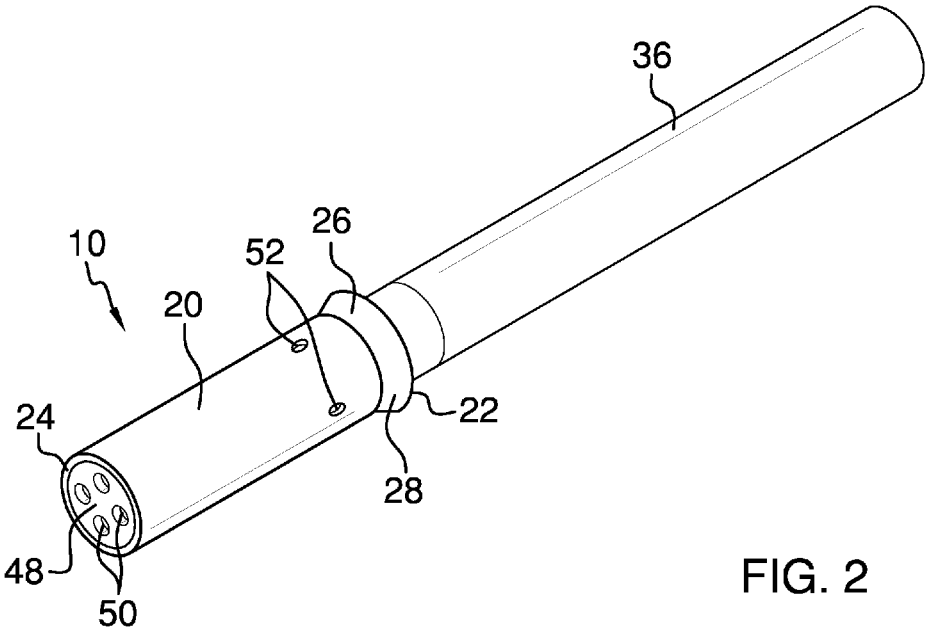
FIG. 2 is a bottom isometric view.
Figure 3:
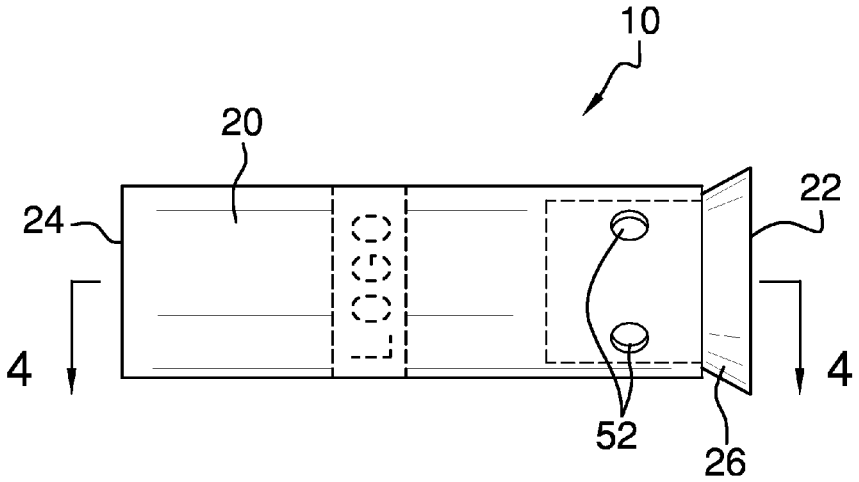
FIG. 3 is a side view.
Figure 4:
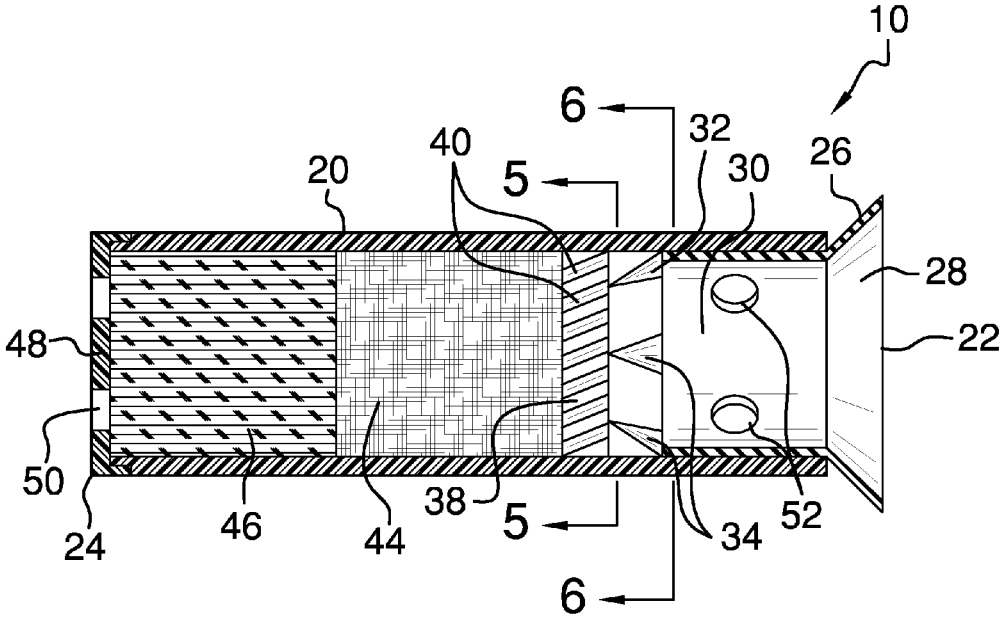
FIG. 4 is a cross section view taken along the line 4-4 of FIG. 3.
Figure 5:
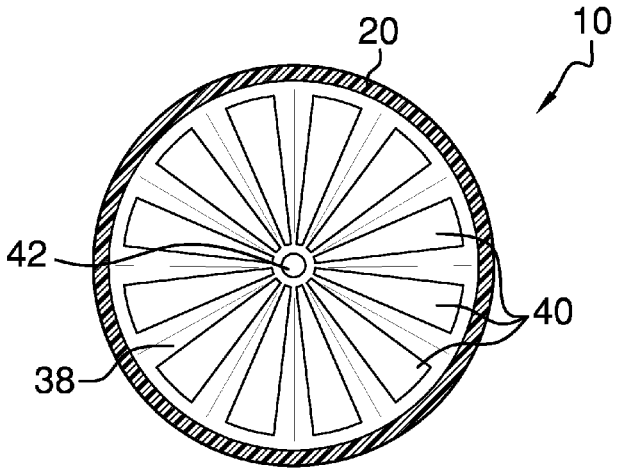
FIG. 5 is a cross section view taken along the line 5-5 of FIG. 4.
Figure 6:
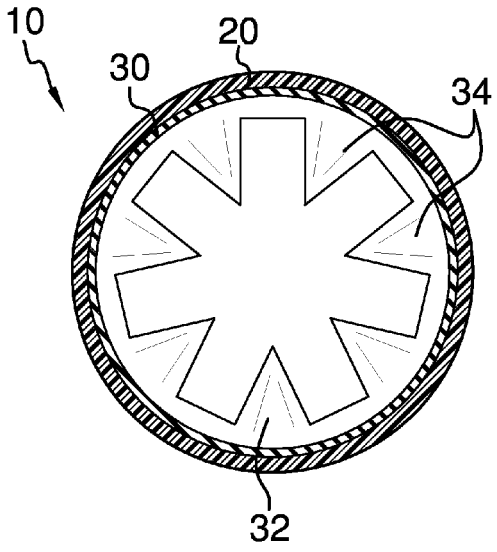
FIG. 6 is a cross section view taken along the line 6-6 of FIG. 5.

With reference now to the drawings, and in particular FIGS. 1 through 6 thereof, example of the instant cigarette filter tip employing the principles and concepts of the present cigarette filter tip and generally designated by the reference number 10 will be described.

Referring to FIGS. 1 through 6 a preferred embodiment of the present cigarette filter tip 10 is illustrated.

The cigarette filter tip 10 includes a hollow right circular cylindrical casing 20. The casing 20 includes a distal end 22 and a proximal end 24. A guide collar 26 is disposed on the distal end 22. This guide collar 26 includes a frustroconical skirting 28, which skirting 28 projects distally from the distal end 22 and flares outwards from the circumference of the casing 20. A right circular cylindrical body member 30 is attached to the skirting 28, the body member 30 disposed within the casing 20 proximal the distal end 22. A crenate piece 32 with converging teeth 34 is connected to the body member 30 within the casing 20 proximal the distal end 22. The converging teeth 34 are disposed facing toward the proximal end 24 of the casing 20 and are configured to releasably receive a cigarette 36 butt therein.

A turbo fan 38 is disposed within the casing 20 immediately behind the crenate piece 32. The turbo fan 38 has a plurality of blades 40 disposed around a central piece 42. The turbo fan 38 is disposed parallel the distal 22 and proximal 24 ends of the casing 20, the plurality of blades 40 rotatable in a transverse plane relative the casing 20. This turbo fan 38 is activated by the breath when smoke is inhaled through the device 10, and the turbo fan 38 thereby spins to ensure an even distribution and homogenization of smoke through the casing 20.

A first filter 44 is disposed within the casing 20 immediately behind the turbo fan 38. A second filter 46 is disposed within the casing 20 proximal the proximal end 24, the second filter 46 disposed immediately behind the first filter 44. Smoke inhaled into the device 10 passes through the turbo fan 38, where it is homogenized and evenly distributed, and enters the first filter 44 as a continuous stream. Smoke then passes through the second filter 46.

A circular strainer 48 is disposed upon the proximal end 24, the strainer 48 disposed parallel the turbo fan 38. The strainer 48 has a plurality of holes 50 disposed therethrough. Smoke inhaled through the device 10 exits through the strainer 48 and into the body of a person smoking through the cigarette filter tip 10.

A plurality of vents 52 is disposed in the casing 20 and through the body member 30. The vents 52 are disposed behind the skirting 28 of the guide collar 26. These vents 52 allow air to be drawn into the device 10 when a person using the device 10 inhales.

Therefore, a cigarette 36 is fittable into the distal end 22 of the present device 10, the cigarette 36 removably secured therein by means of the crenate piece 32, whereby smoke drawn from the cigarette 36 during inhalation is drawn through the turbo fan 38 to be homogenized and evenly distributed through the first filter 44 and then subsequently the second filter 46 before passing through the strainer 48 and entering the body of a person smoking.

It is envisioned that the present device 10 may include additives within the first 44 and the second 46 filter, which additives may flavor the smoke inhaled through the device and alternately reduce the harmful agents within the smoke by chemically reacting therewith. The turbo fan 38 therefore homogenizes and evenly distributes the smoke passing into the first 44 and subsequently second 44 filters, thereby increasing contact between the smoke particles and the active surfaces of each of the first 44 and second 46 filters. Therefore, the present cigarette filter tip 10 is more effective at capturing and treating harmful agents present in cigarette smoke.

What is claimed is:

1. A cigarette filter tip comprising:

a hollow right circular cylindrical casing having a distal end and a proximal end;

a turbo fan disposed in a transverse plane within the casing;

a filter section disposed within the casing;

wherein the turbo fan homogenizes and evenly distributes smoke inhaled into the device whereby contact between the active surfaces of the filter section and the smoke particles is increased;

a guide collar disposed on the distal end, the collar comprising:

a frustroconical skirting projecting distally from the distal end, the skirting flared outwards from the circumference of the casing;

a hollow right circular cylindrical body member attached to the skirting, the body member disposed within the casing proximal the distal end;

a crenate piece with converging teeth connected to the body within the casing proximal the distal end, the converging teeth disposed facing toward the proximal end of the casing;

a first filter disposed within the casing immediately behind the turbo fan;

a second filter disposed within the casing proximal the proximal end, the second filter disposed immediately behind the first filter;

a circular strainer disposed upon the proximal end parallel the turbo fan, the strainer having a plurality of holes disposed therethrough;

a plurality of vents disposed in the casing and the body member, the vents disposed behind the skirting;

wherein a cigarette is fittable into the distal end and removably secured therein by means of the crenate piece, whereby smoke inhaled through the cigarette filter tip is homogenized and evenly distributed through the first filter and the second filter before entering the body of a person smoking.

2. The cigarette filter tip of claim 1 wherein the first filter includes additives to flavor the smoke inhaled and to lessen the harmful effects of the cigarette smoke.

3. The cigarette filter tip of claim 1 wherein the second filter includes additives to flavor the smoke inhaled and to lessen the harmful effects of the cigarette smoke.

4. The cigarette filter tip of claim 3 comprising:

a hollow right circular cylindrical casing having a distal end and a proximal end;

a guide collar disposed on the distal end, the collar comprising:

a frustroconical skirting projecting distally from the distal end, the skirting flared outwards from the circumference of the casing;

a hollow right circular cylindrical body member attached to the skirting, the body member disposed within the casing proximal the distal end;

a crenate piece with converging teeth connected to the body within the casing proximal the distal end, the converging teeth disposed facing toward the proximal end of the casing;

a turbo fan disposed within the casing immediately behind the crenate piece;

a first filter disposed within the casing immediately behind the turbo fan;

a second filter disposed within the casing proximal the proximal end, the second filter disposed immediately behind the first filter;

a circular strainer disposed upon the proximal end parallel the turbo fan, the strainer having a plurality of holes disposed therethrough;

a plurality of vents disposed in the casing and the body member, the vents disposed behind the skirting;

wherein a cigarette is fittable into the distal end and removably secured therein by means of the crenate piece, whereby smoke inhaled through the cigarette filter tip is drawn through the turbo fan to be homogenized and evenly distributed through the first filter and the second filter before entering the body of a person smoking.

* * * * *